United States Patent [19]

Elsworth

[11] 4,373,560

[45] Feb. 15, 1983

[54] APPARATUS FOR FILLING CAULKING TUBES

[75] Inventor: Robert M. Elsworth, c/o Sam Gray, Main Box 19, Georgetown, Exuma, The Bahamas

[73] Assignee: Robert M. Elsworth, Londonville, N.Y.

[21] Appl. No.: 31,115

[22] Filed: Apr. 18, 1979

[51] Int. Cl.[3] ..... B65B 3/12

[52] U.S. Cl. ..... 141/129; 141/242; 141/261; 137/625.19; 222/484; 308/187.1

[58] Field of Search ..... 141/258, 259, 260, 261, 141/237-245, 129, 94, 95, 96, 198, 130-192, 250-257, 262-284; 222/380, 484; 137/625.19; 308/207 R, 187.1

[56] References Cited

U.S. PATENT DOCUMENTS 1,690,067 10/1928 Weeks ..... 141/242

3,098,506 7/1963 Spragens ..... 137/625.19

3,400,739 9/1968 Dardaine et al. ..... 141/261

*Primary Examiner*—Houston S. Bell, Jr.

*Attorney, Agent, or Firm*—E. Philip Koltos

[57] ABSTRACT

An improved apparatus for filling caulking tubes with a viscous liquid composition comprising, a frame; a drive at the lower portion of the frame driving a conveyor belt containing initially empty caulking tubes; a reservoir at the top portion of the frame having therein said viscous composition; a linkage driven by said drive and extending above the lower portion of said frame to the upper portion of said frame; a valve block including a valve core located immediately beneath said reservoir; and, a piston arrangement, wherein the viscous material passes through said valve block, said valve core and piston arrangement from said reservoir into the empty caulking cartiridges which apparatus is sufficiently strong to handle extremely viscous compositions without damage.

26 Claims, 8 Drawing Figures

216
218
2
210
212
160
162
220
230
222
88
90
92
94
74
78
70
3
3
156
152
242
244
158
80
82
110
112
106
114
116
120
122
22
130
140
140
150
140
140
130
100
104
186
186
186
190
190
190
64
64
64
62
62
62
20
50
52
2
34
40
30
44
46
24
16
14
10

APPARATUS FOR FILLING CAULKING TUBES

BACKGROUND OF THE INVENTION

The present invention relates to an apparatus for filling caulking tubes and more particularly the present invention relates to an apparatus for filling caulking tubes with one-component room temperature vulcanizable silicone rubber compositions.

Caulking tubes are well known. Such caulking tubes or cartridges are usually filled with compositions which it is desired to prevent being exposed to atmospheric moisture or the elements prior to cure. When it is desired to use the material in the caulking cartridge, the tip of the nozzle of the caulking cartridge is cut and the caulking cartridge is put in a caulking gun whereupon a piston applies pressure to the plunger at the rear end of the caulking tube and forces the material out of the caulking tube.

The means for filling such caulking tube is an art in itself. In the past there have been developed machines for filling caulking tubes or other packages with a low viscosity material, automatically. Such machines would fill the caulking cartridges or other packages with a low viscosity material. Generally, such an apparatus comprises a drive means which drives a conveyor belt at the lower portion of the machine. The conveyor belt means contained receptacle means for positioning and maintaining in a vertical position for 1 thru 6 empty caulking tubes. There was reservoir means in the upper portion of the frame of the machine in which there was present the composition that was desired to be packaged. From the drive means there was linkage means, and what shall be referred to as "valve means" which generally comprises a cylindrical shaft which was present and revolved in a rectangular block and which cylindrical block had cut-out cavities. There was also affixed to such cylindrical shaft means, piston and cylinder means. Accordingly, the drive means would drive the linkage means which would drive the piston means to create a suction in the piston and cylinder means so as to force by gravity feed as well as suction the composition from the reservoir means into the cavities in the cylindrical shaft means as well as the spaces that were present in the piston and cylinder means. Then by the valve core means being turned in a downward direction by the linkage means and by the pistons being actuated to force the composition out of the cylinder and piston means, the composition would be forced out of the cylinder and piston means and out of the core means through passage tubes and into the empty caulking cartridges as the empty caulking cartridges presented themselves in time synchronization beneath the pallet means and the block means at the proper moment. This would be done such that all the caulking tubes under fill tubes would be filled with the composition at one time. Then the conveyor means would carry the cartridges further where the caulker caps would be inserted in the rear end of the caulking tubes so as to seal the composition that was in the caulking tubes.

It should be noted that the cavities in the core means which was present within the block means, as well as in the cylinder and piston means, was such that only the desired quantity of material was deposited in such cavities during the suction action of the cylinder and piston means such that when the piston of the piston and cylinder means forced the composition out from said cylinder and piston means through said core means and block means into the caulking cartridges only the desired quantity of material was deposited in the empty caulking tubes. Such apparatuses were advantageous for filling non-viscous compositions. They had certain disadvantages with respect to viscous compositions. Thus, with viscous compositions such as room temperature vulcanizable silicone rubber compositions which may have a viscosity in the uncured form of anywhere from 50,000 centipoise to 1,000,000 centipoise at 25° C., difficulty was encountered. For instance, in the prior art machine the shaft or core means would be composed of carbon steel while the block means was composed of cast iron, and the steel shaft would rotate in the bore present in the cast iron block with only teflon ring means at the extreme ends of the block and shaft means sealing the two operating members. However, viscous silicone compositions such as, one-component room temperature vulcanizable silicone rubber compositions mentioned above are very hard on the surface of such steel core and cast iron block means and would result in the cast iron being worn away all too rapidly. Brass was attempted to be utilized for a core means. However, even that wore away too quickly and also had a tendency to turn the silicone composition green. Accordingly, it was decided to utilize a carbon steel or stainless steel core, that is, a cylindrical shaft means and stainless steel or cast iron block in which the core rotated. However, even though such stainless steel or carbon steel did not affect the color of the silicone compositions or other compositions that might be put through such an apparatus, nevertheless, there was difficulty in that rapid metal-to-metal wear would result in the core means.

This would cause the core means to grow smaller or the block to enlarge in size or egg-shaped in cross-section and result in silicone composition or other type of composition being packaged leaking from the machine and being deposited on the caulking cartridges such that it resulted in dirty caulking cartridges which may have to be rejected.

In another respect, it was disadvantageous since it is desired to keep such one-component room temperature vulcanizable silicone rubber compositions free from atmospheric moisture; otherwise, the composition will cure to an elastomer. Accordingly, with the wearing away of such core means, air would leak into and get forced into the uncured silicone composition and would result in the composition prematurely curing in the apparatus or in the caulking tube which was extremely undesirable. Accordingly, it was highly desirable to find a modification or improvement in such core means and block means in such caulking tube apparatus filling machinery such that the apparatus could be filled without prematurely curing the silicone composition.

In addition, it should be noted in order to repair such apparatuses after the core means have been ground to a smaller shape or egg-shaped from the undue wear or metal-to-metal wear between the core means and the block means, it was necessary to regrind the block means so that the bore passing through it was circular in cross-section and to obtain a new core means which would be of the appropriate size in the enlarged bore of the block means. This, as can be appreciated, was an unduly expensive repair procedure to follow. Also, this repair procedure was expensive in that the down time for the machine kept the apparatus from working on the assembly line to fill the necessary amount of cartridge tubes.

Accordingly, it was highly desirable to find a means for substantially reducing the wear between the core means and the block means for such caulking tube filling machinery for viscous, abrasive materials. In the past, also, such machines had been made for the filling of four empty caulking cartridges at a time. Accordingly, it was highly desirable to increase such filling capacity to 6 empty cartridges at a time so as to increase the production that was possible from the packaging operation with the same number of operators.

One difficulty for making a machine capable of filling 6 cartridges at a time was that it was not possible to make a precision block with a bore long enough to accommodate the filling of 6 cartridges to package these silicone materials, which under heat and pressure revert to abrasive silica and which as the result of the core and housing rubbing in contact is followed by deformation of the core because of its length to accommodate 6 caulkers. Accordingly, this was a problem in the prior caulking tube filling apparatuses.

Accordingly, it is one object of the present invention to provide for an apparatus for filling caulking tubes in which there is substantially reduced wear between the core means and the block means in said apparatus.

It is another object of the present invention to provide for an apparatus for filling caulking tubes which can fill 6 caulking tubes at one time under heavy pressures such as required for packaging silicone compounds which can be 8,000 lbs. per piston or 24 tons for a six-line machine.

It is an additional object of the present invention to provide for an apparatus for filling caulking tubes in which the valve core or shaft means through which the composition passes which is to be placed in the caulking tubes, that said shaft rotates in a valve block supported by means of sealed roller bearings.

It is yet an additional object of the present invention to provide an apparatus for filling caulking tubes with a viscous silicone composition in which there is substantial less wearing between the core means and the block means through which the viscous composition passes before it passes into the caulking tubes.

These and other objects of the present invention are accomplished by means of the invention shown in the Figures below.

FIGURES

SUMMARY OF THE INVENTION

In accordance with the above objects and figures there is provided by the present invention an improved apparatus for filling caulking cartridges with viscous liquid compositions comprising, a frame; a drive means at the lower portion of said frame driving conveyor belt means which conveyor belt means passes through the lower portion of said frame said conveyor belt means carrying a plurality of caulking tubes which are initially empty; a pressurized reservoir means located at the top portion of said frame having therein stored viscous composition; linkage means driven by said drive means and extending from the lower portion of said frame to the upper portion of said frame; block means located beneath said reservoir means on said frame and containing therein core means with cavities for receiving said viscous composition; and piston and cylinder means located adjacent to said block means and core means wherein said linkage means drives said core means and said cylinder and piston means to receive measured quantities of said viscous composition from said reservoir means and deposit said viscous composition in empty caulking cartridges passing on said conveyor belt means beneath said core means and said piston and cylinder means where said core means rotates in said block means by the use of roller bearing means.

DESCRIPTION OF THE PREFERRED EMBODIMENT

Figure 1:
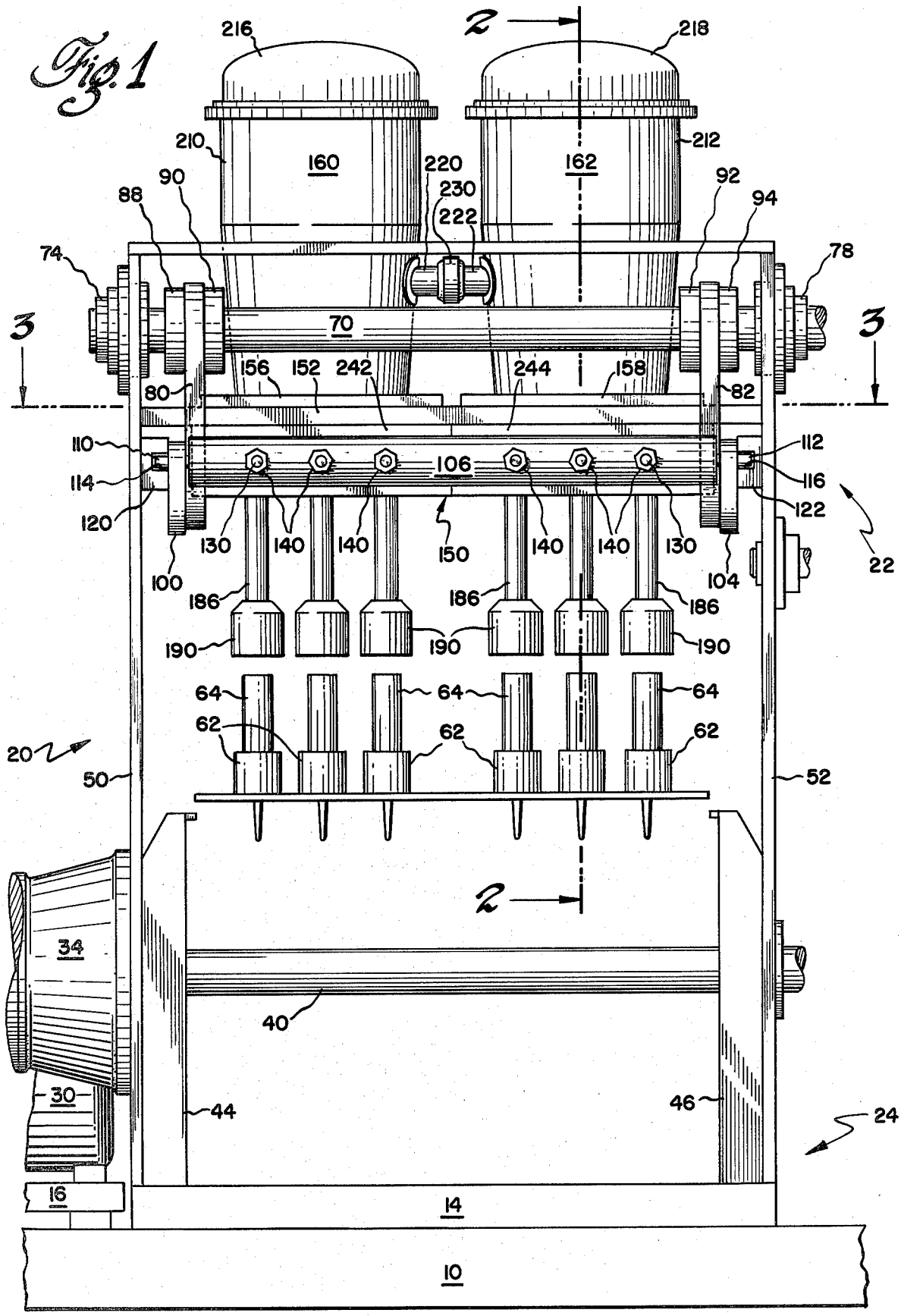
FIG. 1 is a front view of the apparatus for filling caulking tubes of the present invention.
Figures 3, 4, 5, 6, 7, 8:
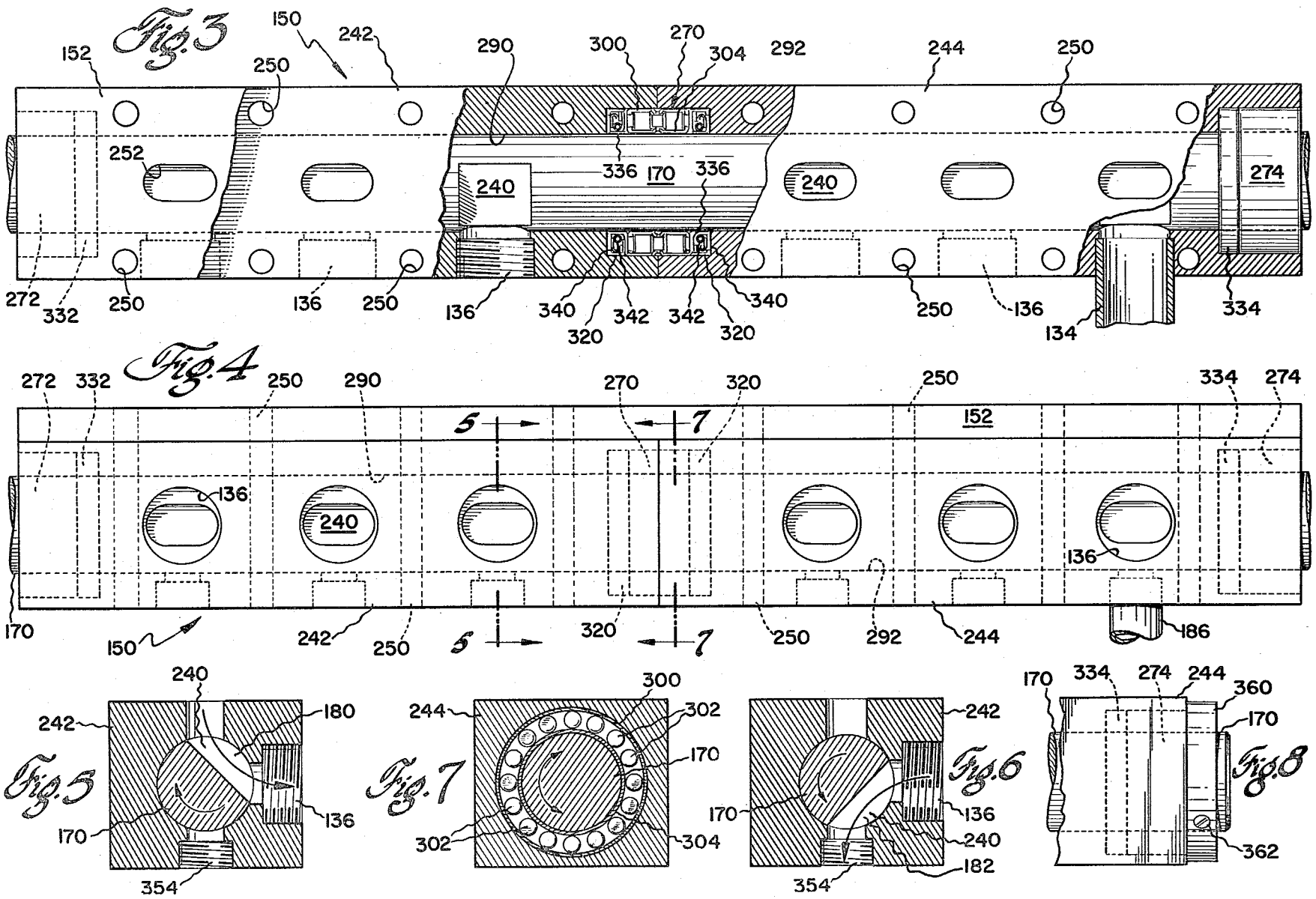
FIG. 3 is a top view, partly sectional view, along lines 3—3 of FIG. 1, looking from the front of the apparatus to the back.
FIG. 4 is an end view or front view of the block and core means along lines 4—4 in FIG. 2.
FIG. 5 is a cross-sectional view along lines 5—5 of FIG. 4 of the block and core means of the apparatus of the instant invention showing material being forced from the reservoir means into the piston and cylinder means.
FIG. 6 is the same cross-sectional view as FIG. 5, and along lines 5—5 in FIG. 4, but showing the material being forced from the cylinder piston means into the passage means for passage into the empty caulking cartridges.
FIG. 7 is a cross-sectional view of the core means and block means along lines 7—7 of FIG. 4.
FIG. 8 is an end view of the core means and block means the same as FIG. 4, showing the retaining ring for retaining the block on the core means.

A front view of the apparatus and specifically the front view of the apparatus with which the present invention is concerned, can be seen in FIG. 1. It should be noted that even though this apparatus is especially suited for packaging one-component room temperature vulcanizable silicone rubber compositions in caulking tubes, it can be utilized to package any viscous material in caulking tubes without the parts and specifically the core means as shown in FIGS. 3 and 4 and the block means being prematurely worn away.

By one-component room temperature vulcanizable silicone rubber composition it is meant any silicone composition which is packaged in a single component and preferably kept away from atmospheric moisture or kept sealed away from atmospheric moisture, and when the composition is exposed to atmospheric moisture it cures to a silicone elastomer. A typical type of such one-component system comprises a silanol-terminated diorganopolysiloxane polymer having a viscosity varying from 500 centipoise to 1,000,000 centipoise at 25° C., and having as a cross-linking agent, methyltriacetoxysilane.

There is preferably incorporated into such compositions a metal salt of a carboxylic acid as a curing catalyst, the metal being selected from metals ranging from lead to manganese in the Periodic Table. Preferably, the catalyst is dibutyl tin dilaurate or another tin salt of a carboxylic acid. To these ingredients there may be added various other types of ingredients well known for one-component room temperature vulcanizable silicone rubber compostions such as, fumed silica or precipitated silica fillers; extending fillers, such as, calcium carbonate, lithopone, zinc oxide, iron oxide and etc.; various adhesion promoters such as, silylisocyanurates, dibutoxydiacetoxysilane and other well known adhesion promoters. The resulting composition when packaged in an anhydrous state remains stable and uncurable, but when exposed to atmospheric moisture, forms a skin in as little a period of time as 10 to 20 minutes and fully cures to a silicone elastomer in 24 hours.

Figure 2:
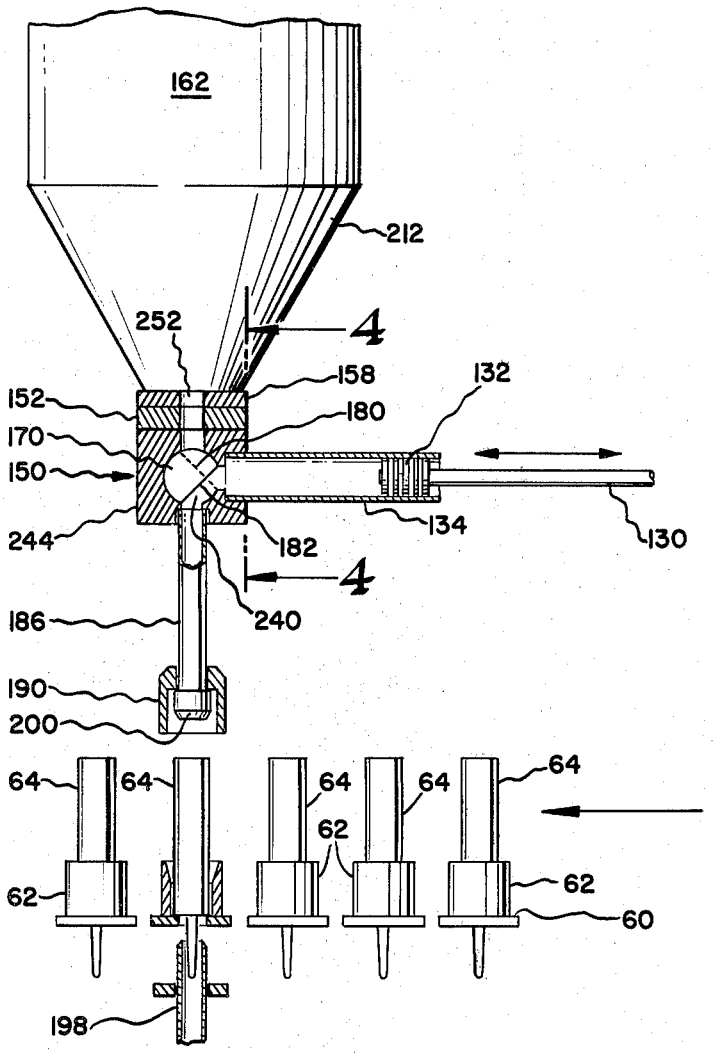
FIG. 2 is a partially cross-sectional view along lines 2—2 of FIG. 1 of the caulking tube filling apparatus of the present invention.

As has been noted previously, although the apparatus of the present invention, that is, the apparatus of FIGS. 1–8, is preferably used to package in caulking tubes such one-component room temperature vulcanizable silicone rubber compositions, it can be utilized to package any viscous liquid composition which has a tendency to be difficult to package in caulking tubes and which has a tendency to wear out the parts of ordinary caulking tube packaging machines. Looking at the drawing of FIG. 1, the apparatus comprises a floor (10) to which is supported base supports (14) and (16). On base support (14) there is the frame of the apparatus (20), having an upper portion (22) and a lower portion (24). To the base support (16) there is affixed motor (30) which drives enclosed gears (34) which drives shaft (40). The drive means which is the electric motor (30) along with the gears (34) and the shaft (40) constitute the drive means of the apparatus of the instant case. Shaft (40) as well as gears (34) are supported by brackets (44) and (46) which are appended to the sides (50) and (52) of frame 20. By means and linkages not shown, the drive means (30) and (34) drives a conveyor belt (60) having six receptacles in alignment in successive rows (62). By means not shown empty cartridges (64) are placed in receptacle (62) of conveyor belt (60), which conveyor belt (60), as can be seen in FIG. 2, moves (looking at FIG. 1) from the plane of the drawing into the drawing. Linkage means which are not shown impart or drive shaft (70) from shaft (40), gears (34) and motor (in the lower portion (24) of frame (20)) so that shaft (70) is maintained on sides (50) and (52) of frame (20) by collars (74) and (78). Shaft (70) is driven such that it reciprocates in its bearings and collars (74) and (78), such that it drives rocker arms (80) and (82) maintained in fixed position by collars (88), (90), (92) and (94), respectively. Rocker arm (80) is connected to connecting arm (100), while rocker arm (82) is connected to connecting arm (104). Connecting arms (100) and (104) are connected to beam (106) through pins (110), (112) which pins (110) and (112) ride in sliders riding in slots (114) and (116) in channel members (120) and (122). The slots (114) and (116) in channel members (120) and (122) maintain the reciprocation of cylinder (106) in the proper perspective with the proper motion and with a minimum of deflection as beam (106) is reciprocated by rocker arm (80) and (82) through shaft (70). For a perspective for the rest of the apparatus with which we are concerned in the pesent invention, it is necessary to go into FIG. 2, FIG. 2 being along lines 2—2 of FIG. 1.

Shaft beam (106) has openings in it through which passes rods (130) to which are appended pistons (132) which ride in cylinders (134). Rods (130) are bolted to beam (106) by nuts (140). Accordingly, as cylinder (106) reciprocates through the reciprocating motion of rocker arms (80) and (82), which are located and driven by shaft (70), rod (130) will also reciprocate through the given range of motion. Behind beam (106) in FIG. 1, there is present in addition to rod (130), piston (132) and cylinder (134), block means (150) which comprises two mechanite, pearlitic iron or carbon steel or stainless steel blocks which are bolted together by plate (152) which is much more clearly seen in FIGS. 3 and 4. On top of retaining plate (152) which maintains two or more parts of block means (150), the reservoirs (160) and (162) rest. In block means (150) there is core means (170) which reciprocates in rotation. Accordingly, in order to appreciate the working of the apparatus, when core means is in dotted line position (180) rod (130) and piston (132) move to the right in FIG. 2, causing material to flow from reservoir (162) into the prescribed area in cylinder (134). When rod (130) and piston (132) have moved to the prescribed position, then core means (170) rotates to position (182) and piston (132) and rod (130) move to the left in FIG. 2, forcing the material in cylinder (134) down through the core means (170), through passage tubes (186) about which is floating guide cap (190) into caulking tubes (64). The travel of piston (132) and rod (130) in cylinder (134) is set such that only the prescribed amount of material is deposited in cartridge (64), with an accuracy of 0.5 to 1% by weight. FIG. 2 also shows grasping member (198) which grasps the bottom part of caulking tube (64) and conveyor belt (60) raises caulking tube (64) around so that the top of caulking tube (64) fits around protected nozzle area (200) which is enclosed by caulker guide cap (190). After the material has been inserted into the caulking tube then retaining member (198) drops down carrying with it the caulking tube (64) to the conveyor belt position for further passage through the apparatus whereupon another part of the apparatus inserts a cap member into the rear end of the caulking tube sealing the caulking tube. The operation of inserting the cap member into the rear end of the caulking tube and sealing the caulking tube forms no part of the present invention and accordingly this part of the apparatus has not been shown in the instant figures.

Before proceeding further into the operation of the instant invention, it is necessary to discuss a preferred embodiment of the instant invention with respect to the reservoirs (160) and (162). Reservoirs (160) and (162) comprise cylindrical conical members (210) and (212) to which is appended tops (216) and (218), which reservoirs (160) and (162) are connected by means of pipes (220) and (222) which pipes (220) and (222) are connected by pipe union member (230). The product is fed from pressurized reservoirs with a level sensing system to control the supply being fed to the filling machine to two independent reservoirs each containing a level control. Because it is necessary to pressurize the reservoir, it is more practical to use two or more smaller tanks than a single larger size to straddle the six line width as the force on the tank lid and walls is a function of the lid area. These reservoirs, tanks or hoppers operate under pressures of 15–25 psi to move the silicone through the valve into the metering pistons to enhance a precise fill delivery. The reservoirs are ASME coded vessels requiring pressure ratings at 45 psi and testing at 90 psi. They also, to be practical, must have easy access quickly through the cover to service level controls or clean the tanks for color changes. To keep the lid-locking system as practical as possible, the smallest diameter reservoir permissible is desirable as the locking arrangement stresses are a function of the square of the tank radius. A lid diameter of 14" is stressed at 13,660 lbs. whereas a 36" diameter tank would have to restrain 90,293 lbs., greatly magnifying the lid restraining and opening problem, plus adding to the cleanout problem and wasteing costly material.

It should be noted that each reservoir holds between five and eight gallons of material, and that each or both reservoirs can be connected to and supplied by larger tanks which automatically pump material into the reservoirs to replace the used material on command of the level control.

Accordingly, it is a more preferred embodiment within the instant invention to have preferably an apparatus in which there are two reservoirs of the viscous liquid material in series with product fed through one to the second and to fill the caulking tubes such that only one reservoir level control system is required to maintain product in the reservoirs, thus keeping the operation of the machine continuous.

Another advantage of having two reservoirs (160) and (162) is that each can be filled with different viscous materials that it is desired to fill the caulking tubes with by interrupting the connection between the reservoirs.

The more important aspect of the present invention in the instant case lies in the means by which the valve core means (170) is allowed to rotate within the block means (150). Valve core means (170) comprises a cylindrical shaft (as can be seen in FIGS. 3 through 8) which has cavities (240) cut into it at six locations. Plate (152) joins or holds blocks (242) and (244) of block means (150) together by bolts passing through the blocks and to plate (152) through bolt holes (250). Cavities (240) are the passageways through the pallet means of cylindrical shaft (170) through which the viscous liquid composition passes from the reservoir into cylinder (134), and then from cylinder (134) into the passage tubes (186) and into cartridge (64). Plate (152) has openings (252) for the passage of the liquid viscous composition therethrough and to cavities (240). Cylinder opening (134) is shown in FIG. 4, in the process for pushing the material through cavity (240) into passage (186) into the caulking tubes (64). It should be noted that there are six cavities (240) in shaft (170). Cylinder (134) is indicated also in FIG. 3.

One of the important aspects of the invention in the instant case lies in making a block for holding six core cavities (240) for filling six empty caulking tubes (64) at a time by utilizing one core means shaft (170) with cavities (240) in it within two blocks (242) and (244) which are bolted together through plate (152).

The other important aspect of the modification and invention of the instant case is in the use of sealed roller bearings (270), (272) and (274).

In the preferred embodiment of the instant invention, one of the basic improvements in the instant invention lies in there being sealed bearings (270), (272) and (274) at the center portion where blocks (240) and (242) are joined so that the core shaft (170) rotates in such sealed bearings thus reducing the wear on the shaft in the bore (290) and (292) in blocks (242) and (244). Such sealed bearings considerably reduce the wear between the core shaft (170) and the bores (290) and (292) of block means (150).

Such sealed bearing means comprise (as can be seen in FIG. 7) an outer steel ring (300) which is fitted in the cut-out portion of blocks (242) and (244), with sealed bearings (302) travelling in ring (300) and around ring (304), which ring (304) is fitted on the pallet shaft (170). Accordingly, as the shaft rotates and reciprocates in motion from one position to another as the caulking tubes are filled by the movememnt of piston (132) and rod (130) and cylinder (134), core shaft (170) will rotate in sealed bearings (302) eliminating abraiding between core shaft (170) and blocks (242) and (244).

It should be noted that the same means that drives rod (130) to reciprocate backwards and forward in piston (132) and cylinder (134), also drives core shaft (182) by linkages not shown in the instant case so that core (170) reciprocates in an oscillating manner from one position to another so as to allow material to go from reservoir (162), as shown in FIG. 2, into the opening of cylinder (134) and then passes from the opening of cylinder (134) by core shaft means (170) into passage tubes (186) and then into the empty caulking tubes. It should be noted that the sealed bearings are such (as can be seen from the drawings and because of retaining rings (300) and (304), that they will prevent the passage of material of silicone composition to two such sealed bearings. However, to improve the seal and to prevent any material from passing by the sealed bearings and particularly to prevent any air from coming from the outside past the sealed bearings into the cavities and in contact with the silicone viscous material, there is utilized reverse oil seal bearings (320), (332) and (334), on either end of sealed bearings (270) and next to the sealed bearings (272), (274) in FIGS. 4 and 5. Reverse oil seal bearings (320), (350), (332) and (334) comprise a leather or neoprene part (336) which is immediately adjacent to shaft (170), and a steel casing (340) in which steel casing there is a loaded steel spring (342) which keeps the seal (336) forced against shaft (170) and the steel casing (340) is pressed against the opening in blocks (242) and (244) to provide a good seal for preventing the passage of viscous silicone compositon therethrough and hopefully preventing the passage of water moisture therethrough.

There is one reverse oil seal means (320) and (352) at each end of center bearings (270) which spring loaded means (320) as shown in FIG. 3 in detail.

There is also reverse oil seal means (332) and (334) at the extreme ends of core means (170) and blocks (242) and (244). However, such reverse oil seal means (332) and (334) have the same construction as reverse oil seal means (350) and (352). Seal bearing means (272) and (274) in the extreme ends of core shaft (170) in bores (290) and (292) of blocks (242) and (244) have generally the same construction as seal bearing means (270) and need not be shown in detail, just their position in FIG. 3 and FIG. 4 being indicated.

Accordingly, with the above sealed bearing means and reverse oil seal means, the amount of wear between the core shaft (170) and the bore (290) and (292) and blocks (242) and (244) is reduced to a great extent and it is possible to operate the apparatus for a much longer time before it becomes necessary to replace any parts as far as the core shaft (170) and the block means (150) are concerned. However, it should be noted that even if repair is necessary then all there is needed to be repaired is to replace the sealed bearing means and the reverse oil seals and the bore of the blocks (242) and (244) need not be reground and a new core shaft (170) need not be obtained in order to get the apparatus properly repaired. Accordingly, the cost of repair is much cheaper with the roller bearing means and the reverse oil seal means of the above invention, as disclosed above.

FIG. 5 and FIG. 6 show the core shaft rotating from one position to another as was indicated in FIG. 2, or when the core shaft (170) is in the position shown in FIG. 5, silicone viscous material is passing from reservoir (162) through opening (252) into core cavity (240) and into cylinder cavity (134). When core (170) is placed in the reverse position (as shown in FIG. 6) the material in cylinder (134) travels through cavity (240), through opening (350) into passage tube (186) and finally into caulking tube (64).

Finally, FIG. 8 shows retaining ring (360) appended to core means shaft (170) and fixed into its position by friction screw (362); one such retaining ring (360) being on each end of the core shaft and block means (160) so as to prevent shaft (170) from moving laterally in the bores (290) and (292) of blocks (242) and (244).

Accordingly, the present invention discloses a novel way for affixing a core shaft (170) and a block means (150) so that it can rotate appropriately to deposit the necessary amount of liquid viscous material in the caulking tubes (64) without wearing away very quickly while at the same time if any wearing away of parts does result as a result of frictional wear, the repair of such worn away parts is inexpensive as compared to the prior repairing procedures.

While, further, it should be noted that the seal that is formed between the core shaft (170) and block means (150), is much superior to that accomplished in the past in the use of sealed bearing means as disclosed above and also reverse oil seal means such that even with wear there is practically no passage of liquid viscous material outside of the core means (170) and block means (150). Such material does not become deposited on the caulking cartridges and result in rejection of such caulking cartridges as being unsightly and also such superior seal means prevents the passage of air into the liquid viscous composition which in the case of one-component room temperature vulcanizable silicone rubber compositions may result in a premature gelling or curing of the composition.

I claim:

1. An improved apparatus for filling caulking cartridges with viscous liqid compositions comprising, a frame;

a drive means at the lower portion of said frame having conveyor belt means which conveyor belt means passes through the lower portion of said frame said conveyor means carrying a plurality of caulking cartridges which are initially empty;

a reservoir means at the top portion of said frame having therein stored said viscous compositions;

linkage means driven by said drive means and extending from lower portion of said frame to the upper portion of said frame;

block means located beneath said reservoir means on said frame and containing therein core means with cavities for receiving said compositions and piston means located adjacent to said block and core means wherein said linkage means drives said core means and said piston means to receive measured quantities of said viscous compositions from said reservoir means and deposit said compositions in empty caulking cartridges passing on said conveyor means under said valve core means and piston means wherein said core means rotates in said block means by the use of roller bearing means.

2. The apparatus of claim 1 wherein said block comprises two or more pieces of meehanite iron or steel rectangular valve blocks which are bolted together through a plate attached to both blocks and wherein said blocks have a bore running through the length of said rectangular blocks.

3. The apparatus of claim 2 wherein said valve core means comprises a single cylindrical carbon steel or stainless steel center shaft which fits in said bores of said rectangular blocks and which cylindrical shaft has six cut-out cavities for receiving and depositing therefrom said compositions.

4. The apparatus of claim 3 wherein between said core means which comprises a cylindrical center shaft and the internal surface of said bores in said blocks there are roller bearing means at each extreme end of said blocks and at the point at which said blocks are joined together.

5. The apparatus of claim 4 wherein said roller bearing means comprises cylindrical sealed bearings but which have an opening through which the cylindrical center shaft passes therethrough.

6. The apparatus of claim 5 wherein at each end of said sealed cylindrical bearings part located where said blocks are joined together there is present seal means.

7. The apparatus of claim 6 wherein at the internal side of said sealed cylindrical bearings parts located at each extreme end of said valve blocks which are joined together there is present oil seal means which prevent silicone compositions from passing between said cylindrical center shaft and said blocks into said sealed bearings.

8. The apparatus of claim 6 or 7 wherein said reverse oil seal comprises a steel, leather or neoprene seal wherein the sealing portion is forced by spring loaded means against said cylindrical center shaft.

9. The apparatus of claim 7 wherein the retaining ring means at each end of said valve steel blocks pass over said center cylindrical center shaft and keeps said cylindrical shaft from being able to have lateral movement with respect to said valve steel block.

10. The apparatus of claim 8 wherein said retaining ring means comprises a ring passing over said cylindrical shaft with a friction screw passing through one portion of it such that the friction screw can lock said ring on said shaft.

11. The apparatus of claim 1 wherein said reservoir means comprises a single cylindrical shaped conical structure feeding by pressure feed said viscous compositions into said cavities in said cylindrical shaft.

12. The apparatus of claim 1 wherein said reservoir means comprises two or more cylindrical shaped conical structures wherein a material forced into the first of said structures passes said viscous composition in said cavities in said core and the second structure is connected to said first structure by passage means so as to accept said viscous composition from said frist structure as said second structure empties of viscous composition as controlled by sensing means in the second structure, or each structure having its own level control which is attached independently to a supply source.

13. The apparatus of claim 1 wherein said liquid viscous composition is a one-component room temperature vulcanizable silicone rubber composition.

14. An improved apparatus for filling caulking cartridges with viscous liquid compositions having, a frame;

a drive means at the lower portion of said frame driving conveyor belt means which conveyor belt means passes through the lower portion of said frame said conveyor means carrying a plurality of caulking cartridges which are initially empty;

a reservoir means at the top portion of said frame having therein stored said viscous composition;

linkage means driven by said drive means and extending from the lower portion of said frame to the upper portion of said frame;

block means located beneath said reservoir means on said frame and containing therein valve core means with cavities for receiving said composition and piston means located adjacent to said block and said core means wherein said linkage means drives said core means and said piston means to receive measured quantities of said viscous composition from said reservoir means and deposit said composition in empty caulking cartridges passing on said conveyor means under core means and piston means comprising the improvement in which there are roller bearing means around the center and ends of said core means to facilitate its rotation in said block means.

15. The apparatus of claim 1 wherein there is further present flow tube means connected to the lower portion of said block means which allow said composition to pass from said core means to said empty caulking cartridges.

16. An improved apparatus for filling caulking cartridges with viscous liquid silicone compositions, comprising:

a frame;

a drive means at the lower portion of said frame driving conveyor belt means which conveyor belt means passes through the lower portion of said frame said conveyor belt means carrying a plurality of caulking tube cartridges which are initially empty;

a reservoir means at the top portion of said frame having therein stored said silicone composition;

linkage means driven by said drive means and extending from said lower portion of said frame to the upper portion of said frame;

block means located beneath said reservoir means on said frame and containing therein a single cylindrical steel center shaft which fits in block means which cylindrical shaft has a number of cut out cavities for receiving said silicone compositions and wherein between said cylindrical center shaft and the internal surface of said block means there are roller bearing means at each extreme end and the center of said cylindrical shaft, wherein said linkage means drives said shaft means and said piston means to receive measured quantities of said viscous composition from said reservoir means and deposit said silicone composition in empty caulking cartridges passing on said conveyor means under said cylindrical shaft, block means and piston means.

17. The apparatus of claim 16 wherein said block means comprises two or more pieces of steel rectangular blocks with bearings at joints which are bolted together by a plate attached to both blocks and wherein said blocks have a bore running through the length of said rectangular blocks.

18. The apparatus of claim 17 wherein said roller bearing means comprises cylindrical sealed bearings which has an opening through which the cylindrical shaft passes therethrough.

19. The apparatus of claim 18 wherein at each end of said sealed cylindrical bearings located where said blocks are joined togehter there is present reverse oil seal means.

20. The apparatus of claim 19 wherein at the internal side of said sealed cylindrical bearings parts located at each extreme end of said steel blocks which are joined together there is present reverse oil seal means between said cylindrical center shaft and said blocks.

21. The apparatus of claims 19 or 20 wherein said reverse oil seal means comprises a steel and leather or neoprene seal wherein the seal portion is forced by spring loaded means against said cylindrical center shaft.

22. The apparatus of claim 20 wherein there is a retaining ring means at each end of said steel blocks passing over said center cylindrical shaft and keeping said cylindrical shaft from being able to have lateral movement with respect to said valve steel blocks.

23. The apparatus of claim 22 wherein said retaining ring means comprises a ring passing over said cylindrical shaft with a friction means passing through one portion of it such that the friction means can lock said ring on said shaft.

24. The apparatus of claim 16 wherein said reservoir means comprises a single cylindrical shaped conical structure passing by pressure feed said viscous silicone composition which is a one-component room temperature vulcanizable silicone rubber composition into said cavities in said cylindrical shaft and said block means.

25. The apparatus of claim 6 wherein said reservoir means comprises two or more cylindrical shaped conical structures wherein the first of said structures passes by pressure feed said viscous silicone composition in said cavities in cylindrical shaft and said piston means and the second structure is connected to said first structure by passage means so as to pass or feed said silicone composition from said first structure into a second or more with the end structure having the level control sensor.

26. The apparatus of claim 16 wherein there are two or more reservoirs mounted on the apparatus of claim 16, each having its own level control system controlling individual input material supply from external source.

* * * * *